US008337274B1

(12) United States Patent
Wong

(10) Patent No.: US 8,337,274 B1
(45) Date of Patent: Dec. 25, 2012

(54) MOTOR BOOSTER FOR TOY VEHICLE

(75) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 0 days.

(21) Appl. No.: 13/285,248

(22) Filed: Oct. 31, 2011

(51) Int. Cl.
*A63H 18/12* (2006.01)

(52) U.S. Cl. ..... 446/454; 446/443; 446/444; 446/456; 446/457; 463/58

(58) Field of Classification Search ..... 446/433, 446/347, 441, 454–457, 462, 465, 444, 484; 463/58, 62; 238/10 E, 10 F
See application file for complete search history.

(56) References Cited

U.S. PATENT DOCUMENTS 3,217,225 A * 11/1965 Gottlieb et al. ..... 320/159
3,223,913 A * 12/1965 Kalns et al. ..... 320/163
3,565,430 A * 2/1971 McRoskey ..... 463/59
3,797,404 A * 3/1974 Barlow et al. ..... 104/304
5,767,655 A * 6/1998 Ostendorff et al. ..... 320/107
5,951,362 A * 9/1999 Siu ..... 446/462
6,139,399 A * 10/2000 DeAngelis ..... 446/484
6,343,972 B1 * 2/2002 Ogawa et al. ..... 446/444
6,586,942 B2 * 7/2003 Lam ..... 324/426
6,776,686 B2 * 8/2004 Todokoro ..... 446/454
2006/0128267 A1 * 6/2006 Yamaguchi et al. ..... 446/454
2006/0183403 A1 * 8/2006 Spenneberg ..... 446/433
2008/0258676 A1 * 10/2008 Lin ..... 320/101
2009/0321168 A1 * 12/2009 Howell et al. ..... 180/197
2010/0130096 A1 * 5/2010 Baarman et al. ..... 446/444
2010/0240276 A1 * 9/2010 Chu et al. ..... 446/456

* cited by examiner

*Primary Examiner* — Gene Kim
*Assistant Examiner* — John E Simms, Jr.
(74) *Attorney, Agent, or Firm* — Greenberg Traurig, LLP

(57) ABSTRACT

A toy car and a remote control regulate the speed of the car. A source of supplemental power selectively energizes the drive motor thereby to selectively permit the vehicle to move faster than the normal speed. A sensor measures the voltage to the vehicle motor. After stepping up the voltage to the drive motor, and detecting a drive motor current increase in excess of the capability of vehicle, the source of supplemental power is disabled. When a normal low voltage state is detected, the source of supplemental power in the vehicle is enabled whereby the motor supply voltage is permitted to increase above a normal low voltage state permitting more power to be provided to motor.

28 Claims, 11 Drawing Sheets

MOTOR BOOSTER FOR TOY VEHICLE

FIELD OF THE DISCLOSURE

The present disclosure relates generally to toy vehicles and, more particularly, to remote control toy vehicles.

BACKGROUND

In racing contest, Nitrous Oxide injection Systems was developed for improving the automotive performance. Nitrous oxide allows the engine to burn more fuel and air, resulting in a more powerful combustion at short period of time.

A variety of toy vehicles such as toy car are known. Like a real car, the remote control toy cars are usually designed to achieve a high or top speed with good controllability. In the past, some tricky toy cars only used 50% power to drive the motor in top speed and then full power i.e. 100% driven in turbo speed. A toy vehicle design having a system to regulate high speed operation would be desirable and provide enhanced entertainment value.

SUMMARY

The present disclosure provides a toy so as to provide amusement to the user.

According to one aspect of the disclosure, a toy vehicle is provided wherein there is a vehicle body, chassis, power source with at least one battery, electronic circuit board for motor speed control, and receiving remote signal from transmitter, at least one electric motor for driving a wheel of the vehicle, a magnetic coil activator or electric motor for wheel steering control and a gear box associated with a wheel and electric motor for power transmission.

To provide for increased speed there is provide an extra energy from power source externally or internally to the vehicle which source can periodically be applied to the vehicle motor.

When the operator of the vehicle desires to have the vehicle speed up, the remote controller is activated and signals a microcontroller inside the vehicle, the microcontroller responds to the signal and applies the extra energy to the motor for driving the wheels.

The disclosure is further described with reference to the accompanying drawings.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which.

DETAILED DESCRIPTION

Figure 1:
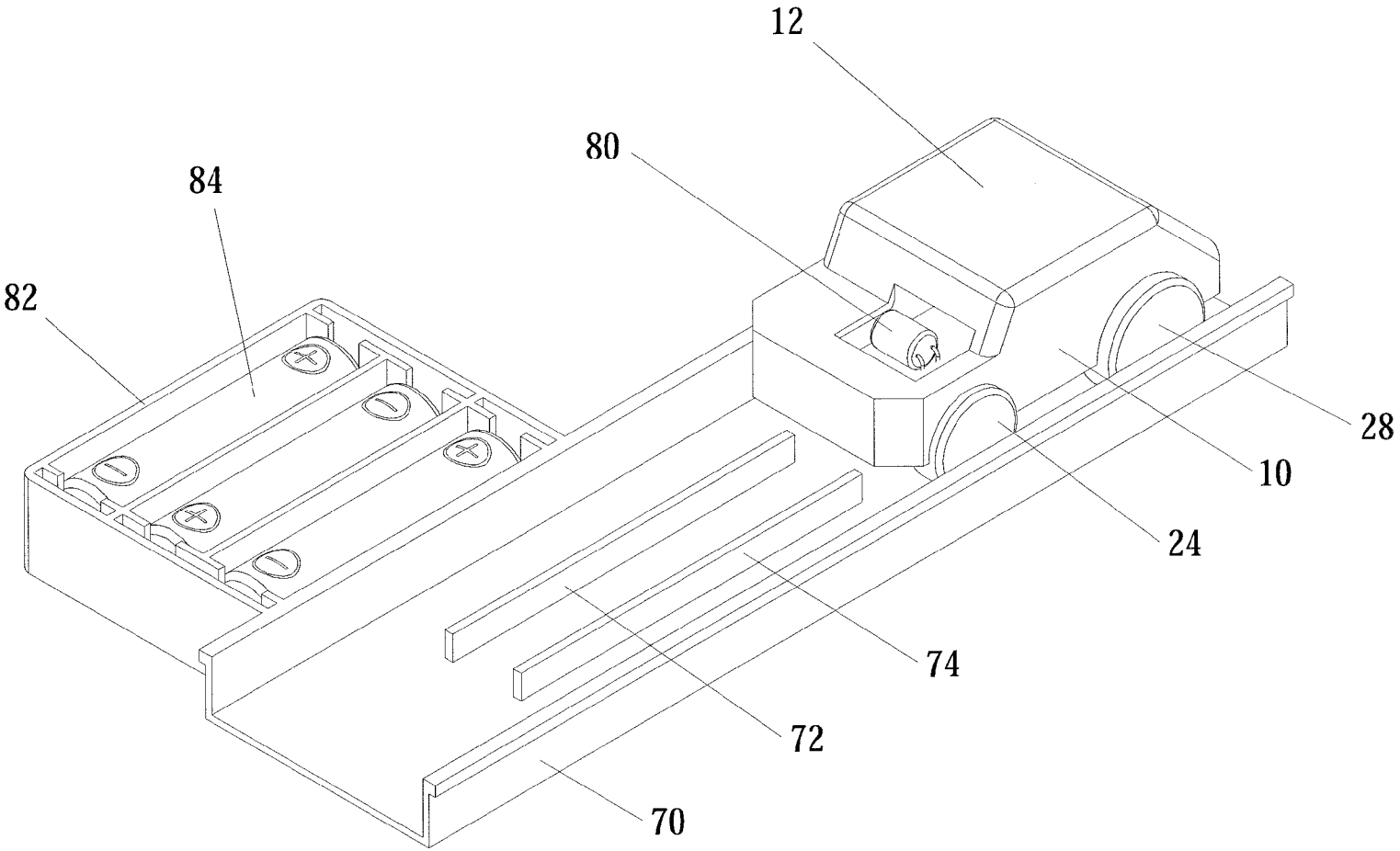
FIG. 1 illustrates the design of special track portion and an external power source mode with a car, partly shown, in the track, and two contact strips along the track and the drive motor and shows the high energy capacitor for charge storage in the car.
Figure 2:
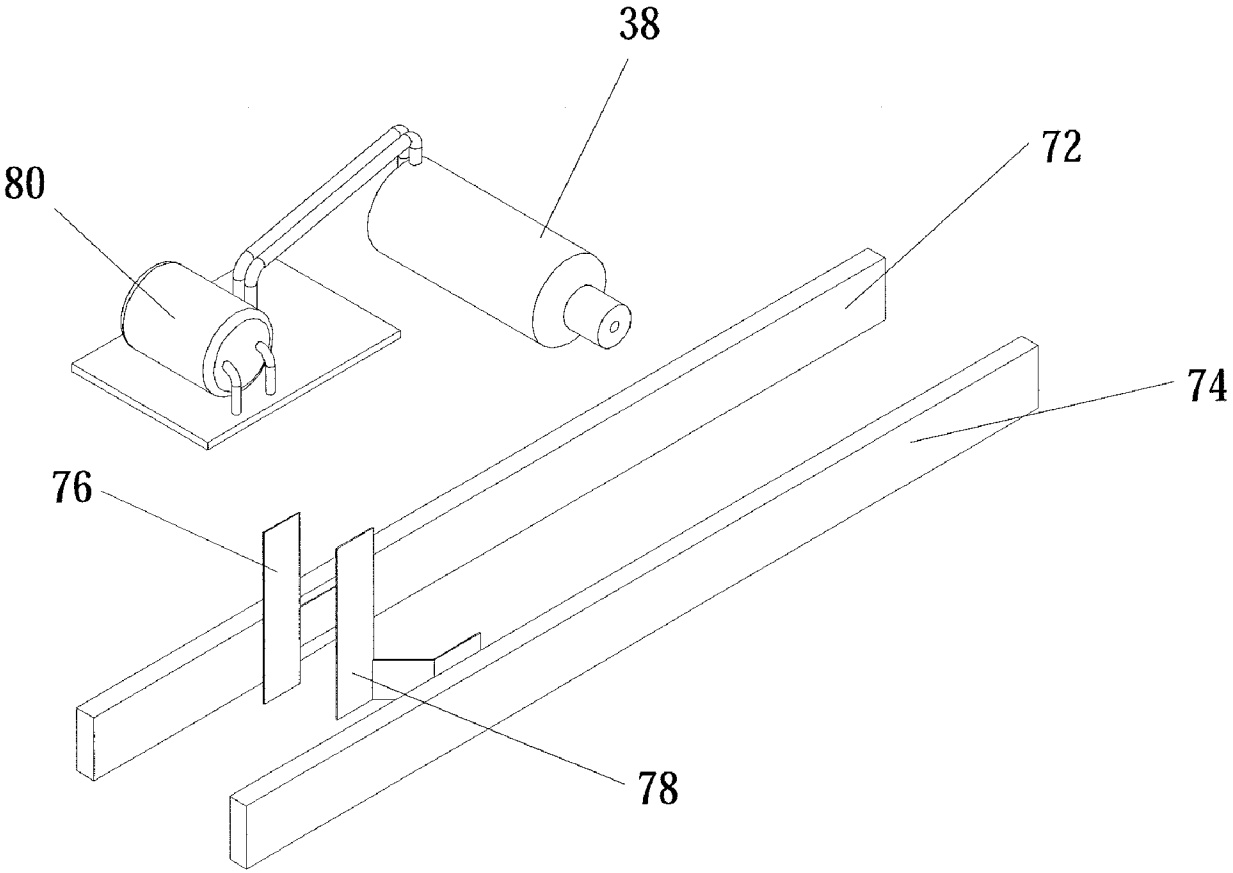
FIG. 2 Illustrates a design of the special track with an external power source mode, and two different contact strips in the track.
Figure 3:
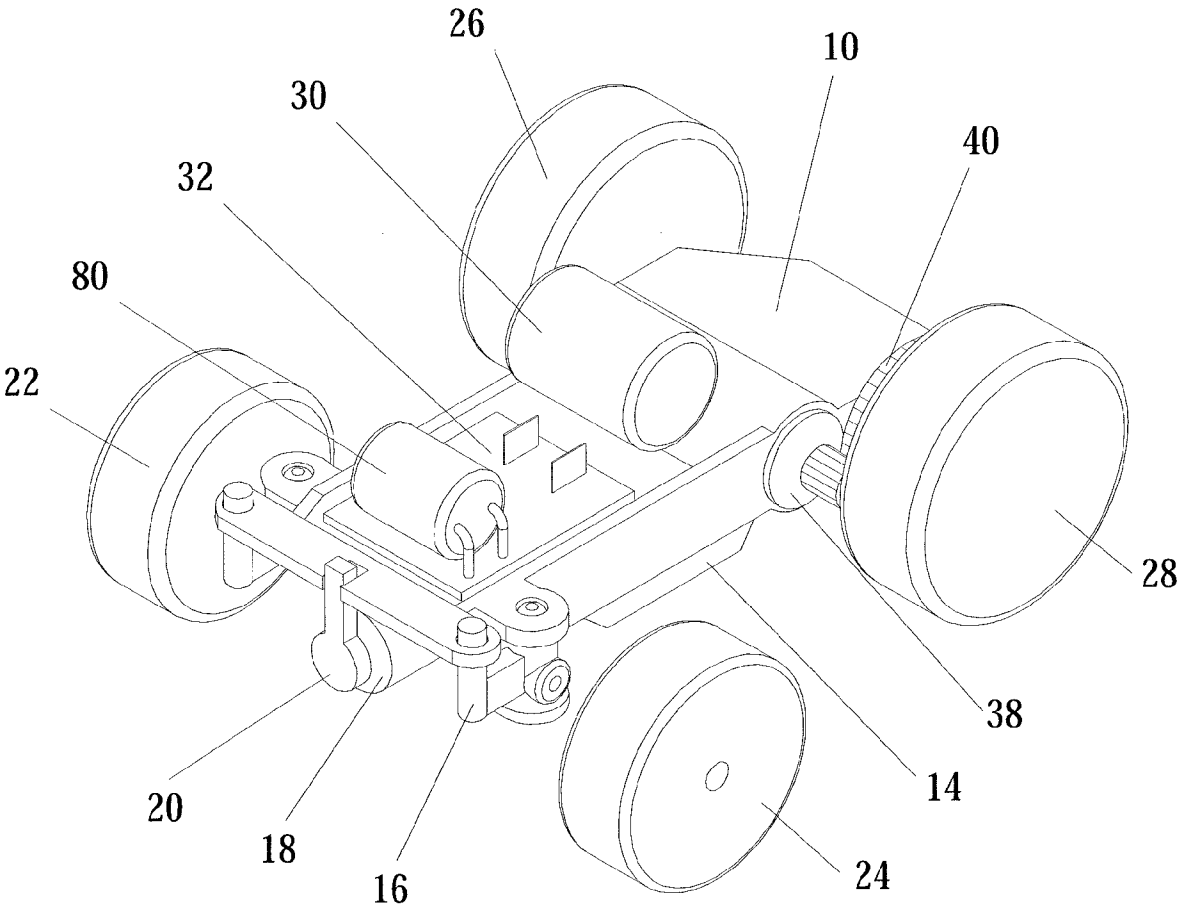
FIG. 3 illustrates the interior part of a toy car.
Figure 4:
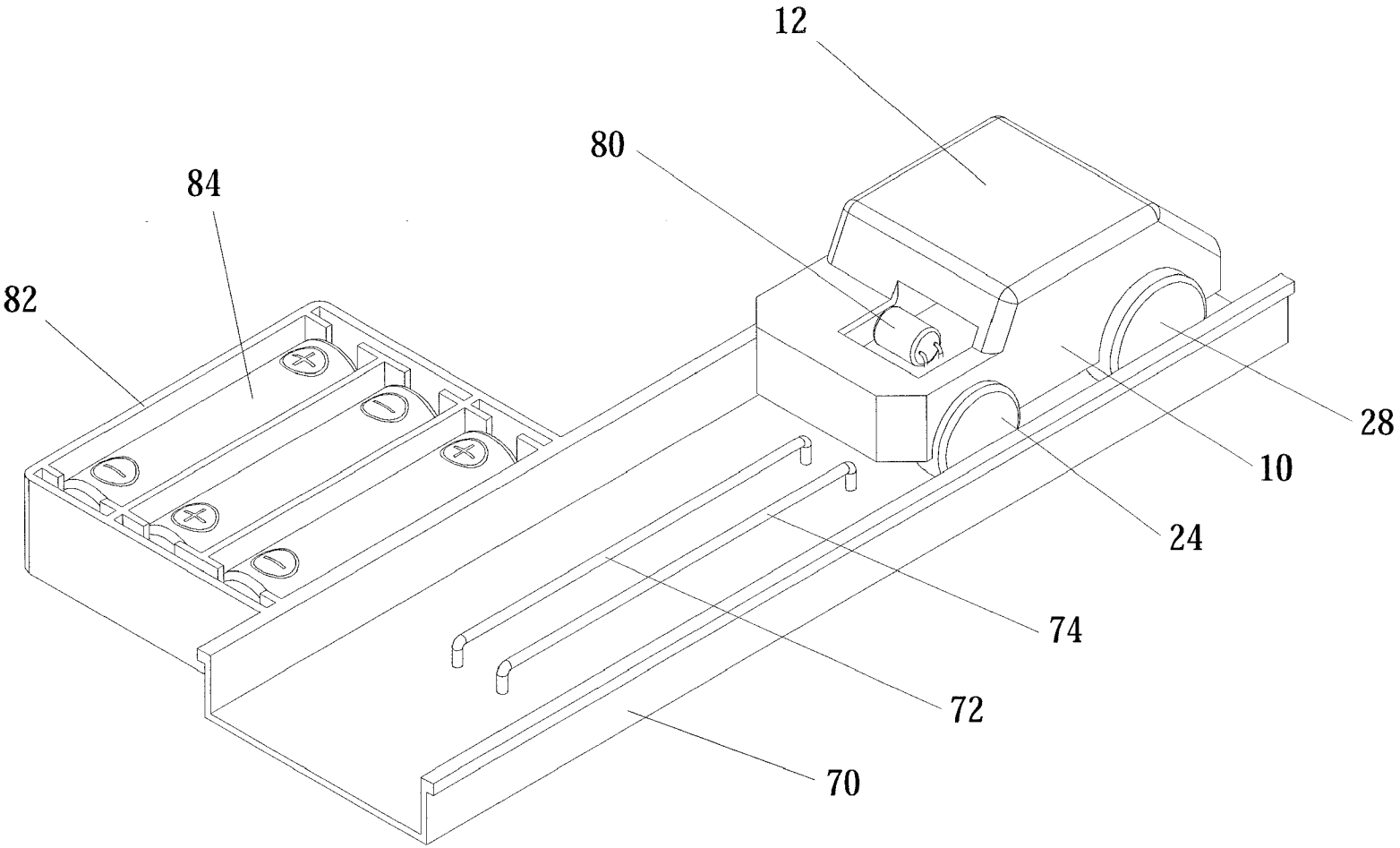
FIG. 4 illustrates an alternative the design of special track portion and an external power source mode with a car, partly shown, in the track, and two contact strips along the track.
Figure 5:
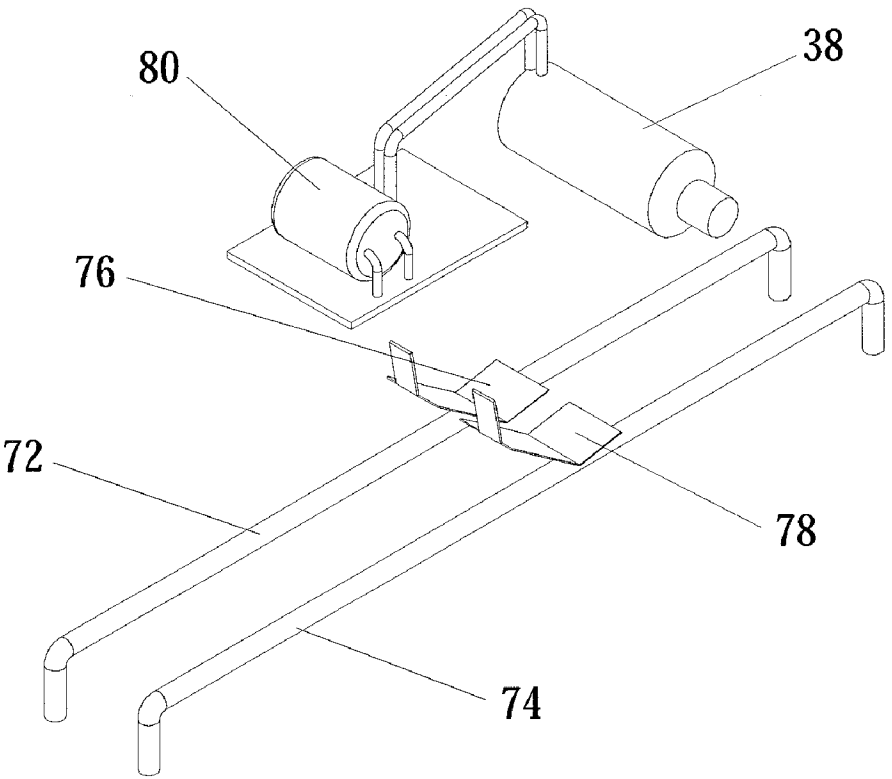
FIG. 5 Illustrates an alternative design of the special track of FIG. 4 with two contacts from the car engaging the strips in the track.
Figure 6:
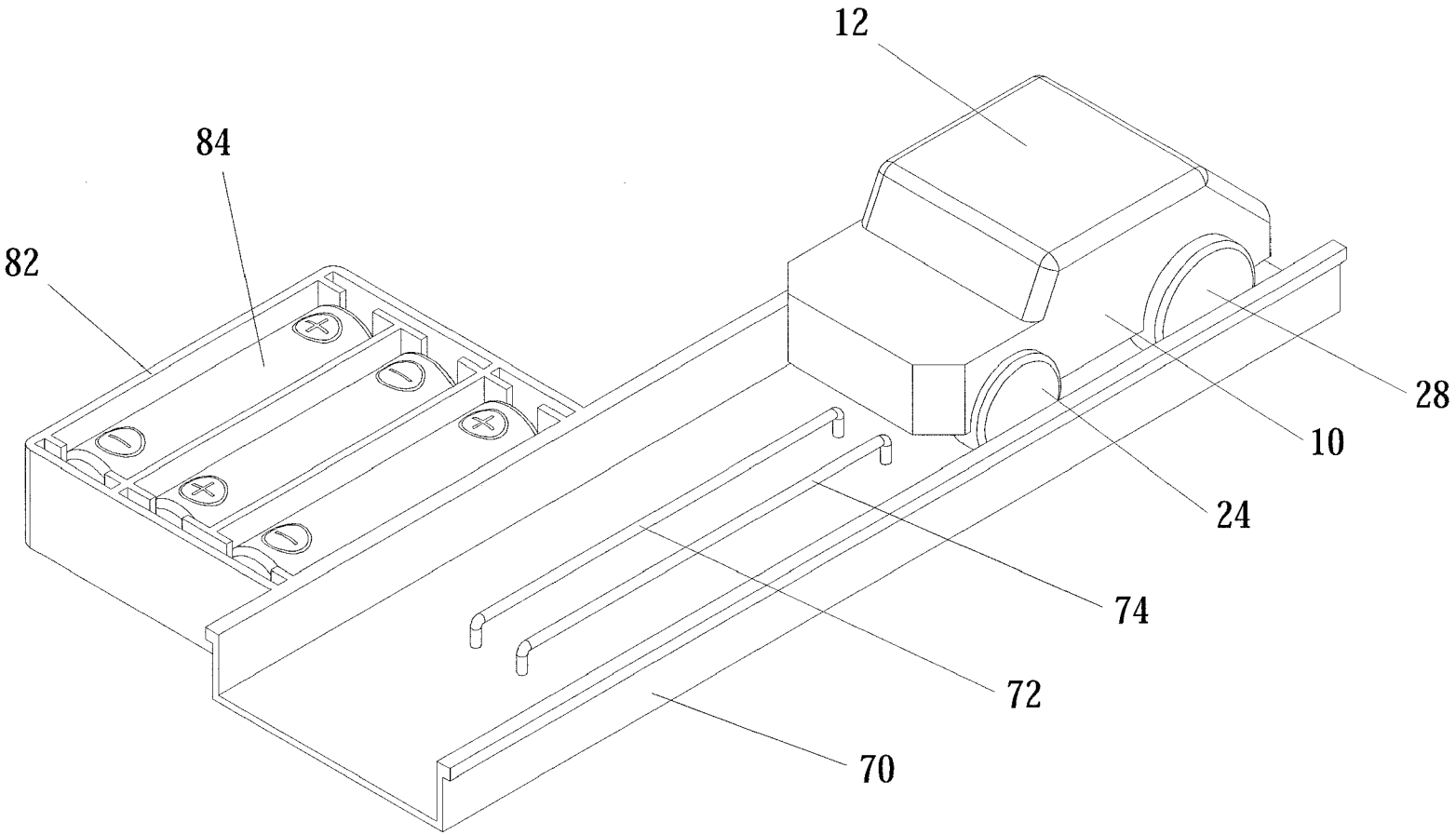
FIG. 6 illustrates an alternative the design of special track portion and an external power source mode with a car, partly shown, in the track, and two contact strips along the track without a storage capacitor.
Figure 7:
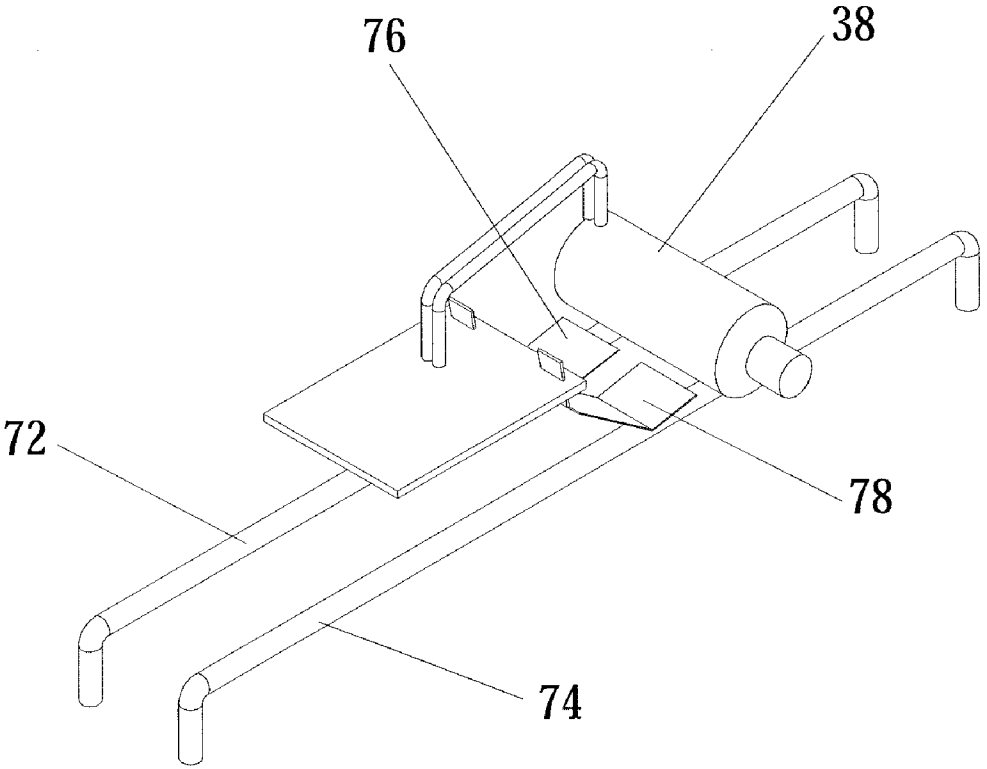
FIG. 7 Illustrates a design of the special track of FIG. 6 with two contacts from the car engaging the strips in the track.
Figure 8:
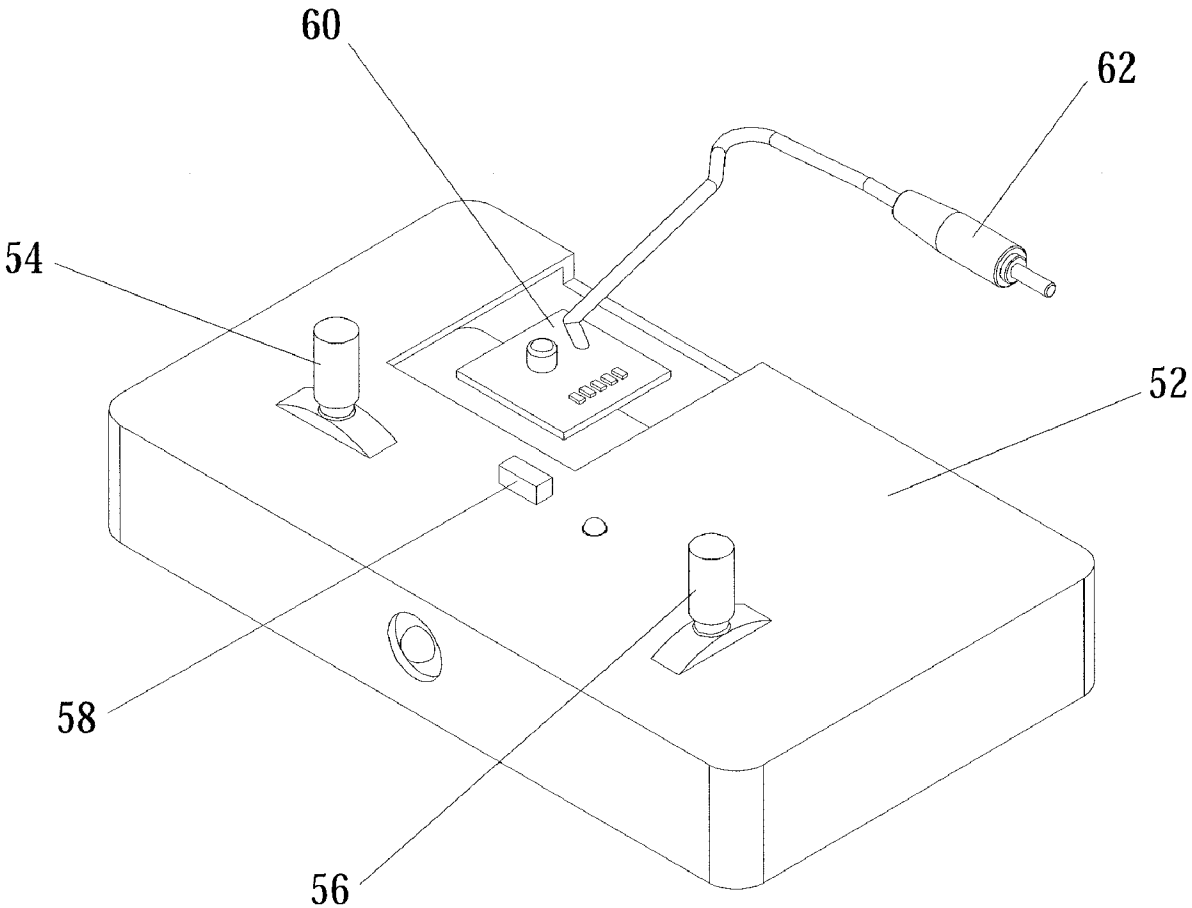
FIG. 8 illustrates the remote controller.

Certain terminology is used in the following description for convenience only and is not limiting. The word "a" is defined to mean "at least one." The terminology includes the words above specifically mentioned, derivatives thereof and words of similar import. In the drawings, like numerals are used to indicate like elements throughout.

Most people desire to have top speed for car and they have the same expectation on toy car. The present disclosure relates the dc motor, booster circuit and power source for providing extra power to driving motor so as to achieve the extreme speed instantly.

A toy car comprises with a car body, chassis, power source with at least one battery, electronic circuit board for motor speed control. There is remote controller to send a signal which is received from the remote control transmitter. There is at least one electric motor for driving the rear wheels. A magnetic coil activator or electric motor acts with at least one of the front wheels for steering control. A gear box is associated with at least one rear wheel and the electric motor for power transmission.

A toy comprises a movable toy vehicle such as a toy car and a remote control device having controls for a user to regulate the movement of the vehicle. The vehicle including a body, a chassis, a power source with at least one battery, at least one drive electric motor for driving a wheel of the vehicle at different speeds.

The speeds include a normal top speed, an electronic circuit for controlling speed of the motor, a receiver with the vehicle for receiving a signal from a transmitter with the remote controller. There is a source of supplemental power for selectively energizing the motor thereby to selectively permit the vehicle to move faster than the normal speed.

There can be a track for the vehicle. The source of supplemental power is connected to the vehicle and provided to the motor when the vehicle passes a select portion of the track.

The track includes a contact for engagement with a mating contact on the vehicle whereby the supplemental power is transmittable to the drive motor.

The toy can include a power storage capacitor with the vehicle as the source of supplemental power for the drive motor is connected to the vehicle. The capacitor is directly or indirectly connected to the motor so that when the vehicle receives a signal from the remote controller the supplemental power is transmittable to the driving motor.

When the operating voltage of the motor is increased suddenly and the additional power supply acts as a motor booster for the vehicle to gain speed instantly along the track.

With a high energy capacitor in the vehicle for charge storage, and when the vehicle passes through the track section, the capacitor is charged. When the remote control signals the electronic circuit of the vehicle, the capacitor is quickly discharged to the drive motor at anytime and thereby the vehicle run faster at that time.

The car can include a sensor for measuring the voltage to the vehicle motor, and after stepping up the voltage to the drive motor, and detecting a drive motor current increase in excess of the capability of vehicle, the source of supplemental power is disabled whereby the motor supply voltage returns to a normal low voltage state When stepping up the voltage to the drive motor, and detecting a drive motor current being essentially normal relative to the capability of vehicle, the source of supplemental power in the vehicle is enabled whereby the motor supply voltage is permitted to increase above a normal low voltage state, and wherein operation of the remote control acts to transmit a signal to the receiver on the vehicle permitting more power to be provided to motor.

Once the whole power system design is fixed, i.e., number of batteries, motor type, gear ratio, body size and weight, and wheel's diameter keep remain unchanged, by law of conservation of energy, more power for motor is not provided unless the input power of motor i.e. the product of input voltage multiplied by input current is increased. This is achieved by obtaining extra energy from power source externally or internally.

With the toy vehicle of the disclosure, a pair of metal brushes or contact plates is provided on chassis or both sides of car body. These brushes or plates are connected to the terminus of rear electric motor.

The vehicle which can be a car can be further designed so that it can run in a track system. There can be a plastic track in which one section of the track includes of two metal strips on a surface area. For conducting electricity from the track to the car, there is provided an external dc power source such as dc adaptor or battery source connected to the metal strips. The supply voltage of the adaptor should be at least 1.1 times higher than the battery level inside the car.

When the car passing through this portion of the track, the dc adaptor or external batteries can provide energy to the rear electric motor inside the car directly. Thus, the operating voltage of motor will be increased suddenly. This additional power supply can act as a motor booster for the car to gain speed instantly along the track.

Alternatively, a high energy capacitor can be located inside the car for charge storage. When the car passes through this portion of the track, the capacitor is charged. By remotely control the electronic circuit board of the car with a transmitter, the capacitor can be quickly discharged to the driving motor at anytime and hence the car can run faster instantaneously.

In both cases, the extra energy is come from external power source. For internal power source method, a dc-dc converter or a transformer is used to step up the motor supply voltage to a higher voltage level. Without step-up the motor supply voltage is equal to battery voltage.

For a well-known d.c. motor equation (1), Ia=(Vm−Eb)/R, where

Vm=supply voltage

Eb=back e.m.f.

R=armature resistance

Ia=armature current

If the motor stalled, rpm=0 and hence Eb=0, the armature current is at max Imax=Vm/R In the contrast, if the motor is turning at high rpm, Eb>0 and the armature current can be reduced. At max motor efficiency, la is approximately equal to ⅓ of Imax.

For a step-up transformer or dc-dc step-up converter, it can be assumed that the conversion efficiency is η. Usually, this value is less than 95% and the voltage input, voltage output, current input and current output of the conversion are denoted as Vi, Vo, li and lo respectively. According to the law of conservation of energy, the power equation (2) is Vo*lo=*Vi*li*η

With step-up conversion, Vo>Vi and lo<li

To provide sufficient energy to motor, the battery capacity and hence the discharge power Pbat should be large. This means that the voltage drop of the battery is not significant even at max current drawn Imax. i.e. In motor stalled condition. In a worse case, the battery power is considered just enough for max current drawn by motor. Then the battery power equation (3) becomes Pbat=Vm*Imax Without dc-dc converter, the input power of a turning motor is Vm*la With dc-dc step-up converter, the input power of a turning motor can be obtained by combining equation (2) and (3)

$$Vo*lo=Vi*li*\eta$$

$$Vo*lo=Vm*\mathrm{Imax}*\eta$$

The power ratio of motor input with and without dc-dc converter is $$\text{Power ratio} = \frac{Vo*I_o}{Vm*I_a} = \frac{vm*Ima_x*\eta}{V_m-I_a} = \frac{I_m ax*\eta}{I_a} \square 3\eta = 2.7$$

Where la is approximately equal to ⅓ of Imax at max motor efficiency and also, the conversion efficiency η of the dc-dc converter is 90% only. Therefore, the total power gain is at least 2.7 times and the motor can run faster at high voltage condition.

After stepping up the voltage and considering that the car is running on a slope, then motor current lo increases and this may exceed capability of battery. As a result, the battery voltage drops significantly and whole power system can collapse. In order to avoid this happening, in present disclosure, the motor current is detected by the analogy to digital port of a microcontroller. If the car is running smoothly, the motor current is in normal condition and MCU allows the transmitter to activate the step-up converter inside the car by simply pressing a button on transmitter. Then more power can be provided to motor and it is running at high voltage state. On the other hand, once the MCU detects the motor current is abnormally high, it will disable the step-up converter immediately to avoid power system collapse. The motor supply voltage will then return to its normal ie. low voltage state.

An electric steering motor or magnetic coil actuator is drivingly coupled with at least one front wheel. There is at least one front wheel coupled with the front portion and located on the vehicle so as to at least partially support the front portion. An electrically operated steering actuator is mounted for drivingly coupling at least one wheel to rotate at least one wheel to steer the toy vehicle.

A toy vehicle comprising a movable vehicle and a remote control device having controls for a user to regulate the movement of the vehicle.

The car preferably includes a pair of front wheels spaced apart to either side of the vehicle body, and a preferably a pair of rear wheels spaced apart to either side of the vehicle body.

There is a remote control device for communicating with a transceiver located with the vehicle. The remote control device includes one or more control levers also for regulating the rotation of the driven wheel. As such the vehicle can be controlled on the one hand by the microcontroller to automatically control the speed of rotation and steering to the wheels.

The toy is a combination with a remote control device configured to selectively control movement of the toy vehicle and activation of the rotational drive mechanism.

The remote control device comprises a handheld remote controller having a multi-part housing, and wherein at least two of the housing parts are pivotable with respect to each other in order to control an operation of the toy vehicle.

In order to obtain high speed, the car should be light. There is a relatively powerful motor to drive at least one of the rear wheels. One or more high energy density LiPO batteries are chosen for the car. There are miniature coreless motors used for driving the front and rear wheels as needed.

There can be one or more sensors to detect voltage of the drive motor. The microcontroller responds to this signal change of voltage and a control signal on a step up converter is enabled or disabled according to the set parameters.

The toy car 10 comprises a body 12. There is the following:

(1) A car housing and chassis 14.

(2) A steering mechanism 16 associated with a small dc motor 18, and gearbox 20 for servo control for steering the front wheels.

(3) Front wheels 22, 24, and rear wheels 26 and 28.

(4) Battery power source 30 such as LIPO, LiFePO4 or Li-ion.

(5) PCBA 32 for electronic microcontroller system control 34 and signal receiver or transceiver 36.

(6) A driving mechanism associated with a powerful dc coreless motor 38 and gearbox(es) 40 driving the rear wheels 26 and 28.

There is a remote controller 52 which is remotely located relative to the car 10 and is used by the user to control speed and direction with different toggle controls 54, 56 and 58 on the face of the controller. There can be a charger unit 60 associated with the controller 52, and the charger is connectable through a cable 62 for recharging the battery 32. In an alternative way, the charger unit 60 can be located inside the car 10, and the primary battery 32 is connected to the charger unit 60.

The front wheels each include a wheel hub and a tire. The hub is attached to a support arm. The support arms can include a top support pin and a bottom support pin. The support arms further include a steering pivot pin.

The steering assembly is coupled to the wheel assemblies to provide powered steering control. The steering assembly is preferably a conventional design that includes a motor, a slip clutch and a steering gear box, all of which can be contained within motor and gear box housing. A steering actuating lever can extend from the motor and gear box housing, and moves from left to right. The steering actuating lever can fit within a receptacle in a tie rod. The tie rod is provided with holes at each opposing end. The steering pivot pins fit within the holes. As the tie rod moves left and right under the action of the steering actuating lever the front wheel assemblies are caused to turn as support arms are pivoted by steering pivot pins. The position of the tie rod can be adjustable by a steering trim mechanism. One of ordinary skill will appreciate that any know steering assembly can be used with the present disclosure to provide steering control of the toy vehicle 10.

The body 12 can be ornamented cover assemblies. The housing and chassis 14 mounts a drive motor 38 for one or more rear wheel assemblies mounted to an axle, and mounted for rotation relative to the housing and chassis 14. The housing and chassis 14 can include drive shaft support members.

A circuit board 32 contains the device electronics is supported by a mounting with the chassis and housing 14. The circuit board 32 is electrically connected with the front motor 18 and rear motor 38. An on/off switch is accessible from the underside of the housing and chassis 14.

The drive assembly can include one or two drive motors 38. The drive motors can be reversible electric motors of the type generally used in toy vehicles. The motors are operably coupled to the axle through a drive gear train. The drive gear train includes a pinion affixed to an output shaft of the drive motors. The motors 38 can drive the rear wheel assemblies through the drive gear train in either a forward or reverse direction. Other drive train arrangements could be used such as belts or other forms of power transmission. The arrangements disclosed herein are not meant to be limiting.

A special track 70 includes two separate contact strips 72 and 74 running down the middle of the track 70 which are for engagement with contacts 76 and 78 which are associated with the vehicle housing and chassis and are connected to the circuit board 32. In this manner power from the strips 72 and 74 can be imparted to charge the capacitor 80 in some forms of the disclosure. In other forms the power from the strips 72 and 74 is directly transferred to power the motor 38 when the strips are powered and the car 10 passes over the strips 72 and 74 so that the contacts 76 and 78 close the over circuit.

The strips 72 and 74 are also connected to an external power source 82 which is illustrated as a bank of batteries 84 for providing the extra voltage and power to the motor 38 as desired. In other cases this can be an AC/DC converter and a supply of mains power can be provided.

In operation, a user drives the toy vehicle 10 so that the vehicle can continue driving in the selected forward or reverse direction. The microcontroller on board is signaled by the voltage sensor and it acts to change the speed of rotation of the wheels when the vehicle as desired and controlled or impart a higher than normal speed under appropriate conditions.

The vehicle 10 can be constructed of, for example, plastic or any other suitable material such as metal or composite materials. From this disclosure, it would be obvious to one skilled in the art to vary the dimensions of the toy vehicle 10 shown, for example making components of the toy vehicle smaller or larger relative to the other components.

The toy vehicle 10 is preferably controlled via wireless signals such as Infrared or radio signal from a remote controller. However, other types of controllers may be used including wired controllers, voice-activated controllers, and the like.

A preferred embodiment of a remote controller for use with the present disclosure preferably comprises a multi-part housing having left hand and right hand toggles. Each of the left hand and right hand toggles are on a top housing. An antenna may be included to receive and/or transmit signals to and/or from the remote controller.

The remote controller also preferably includes circuitry to, for example, process inputs from the switch, the left and right toggles, switches, and to transmit and receive signals to and from the toy vehicle 10.

Figure 9:
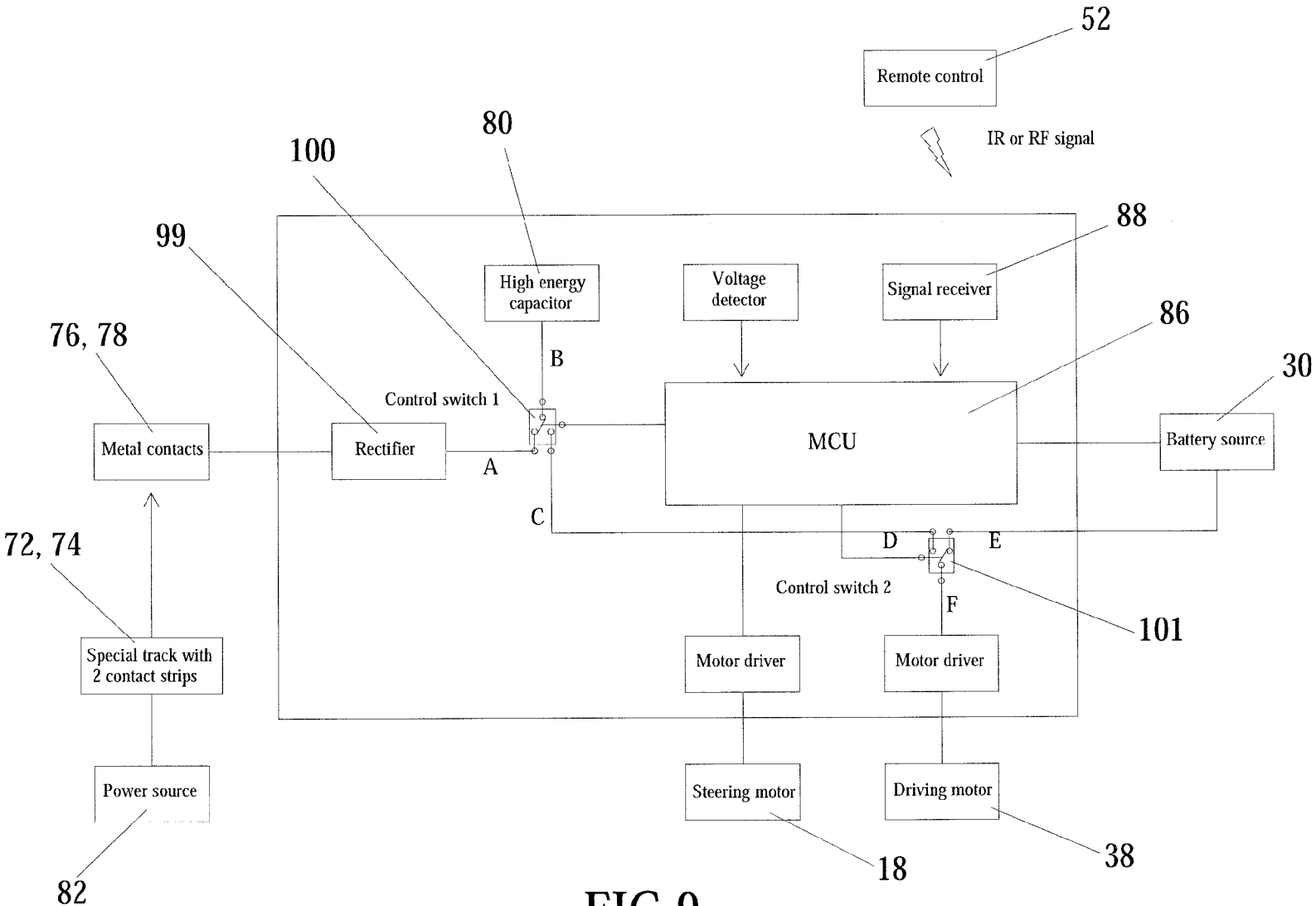
FIG. 9 shows the block diagram of whole vehicle system with a capacitor and also the remote control interaction.

The operation of FIG. 9, the mode with a capacitor is described. While charging, the MCU switches the control switch 1, namely switch 100, to position A. The current will flow from the metal contact through rectifier 99 to the capacitor 80. To ensure correct polarity, the rectifier 99 is used. Then the current flows to point A must be positive. In normal play, the MCU selects the control switch 2, namely switch 101 to position E. The motor supply comes from battery source 30 and the motors can run in normal top speed. A voltage detector is used to monitor the capacitor 80 voltage level. If the voltage level is higher than a threshold value (>battery source voltage level), the vehicle enters "Ready for Turbo" mode. If the corresponding Turbo command is received from the signal receiver 88, the MCU switches the control switches 100 and 101 to positions C and D respectively. The capacitor 80 discharges to the motor driver and the driving motor 38 accelerates instantly. After the capacitor 80 voltage level drops, the control switch 101 switch back to position E again.

Figure 10:
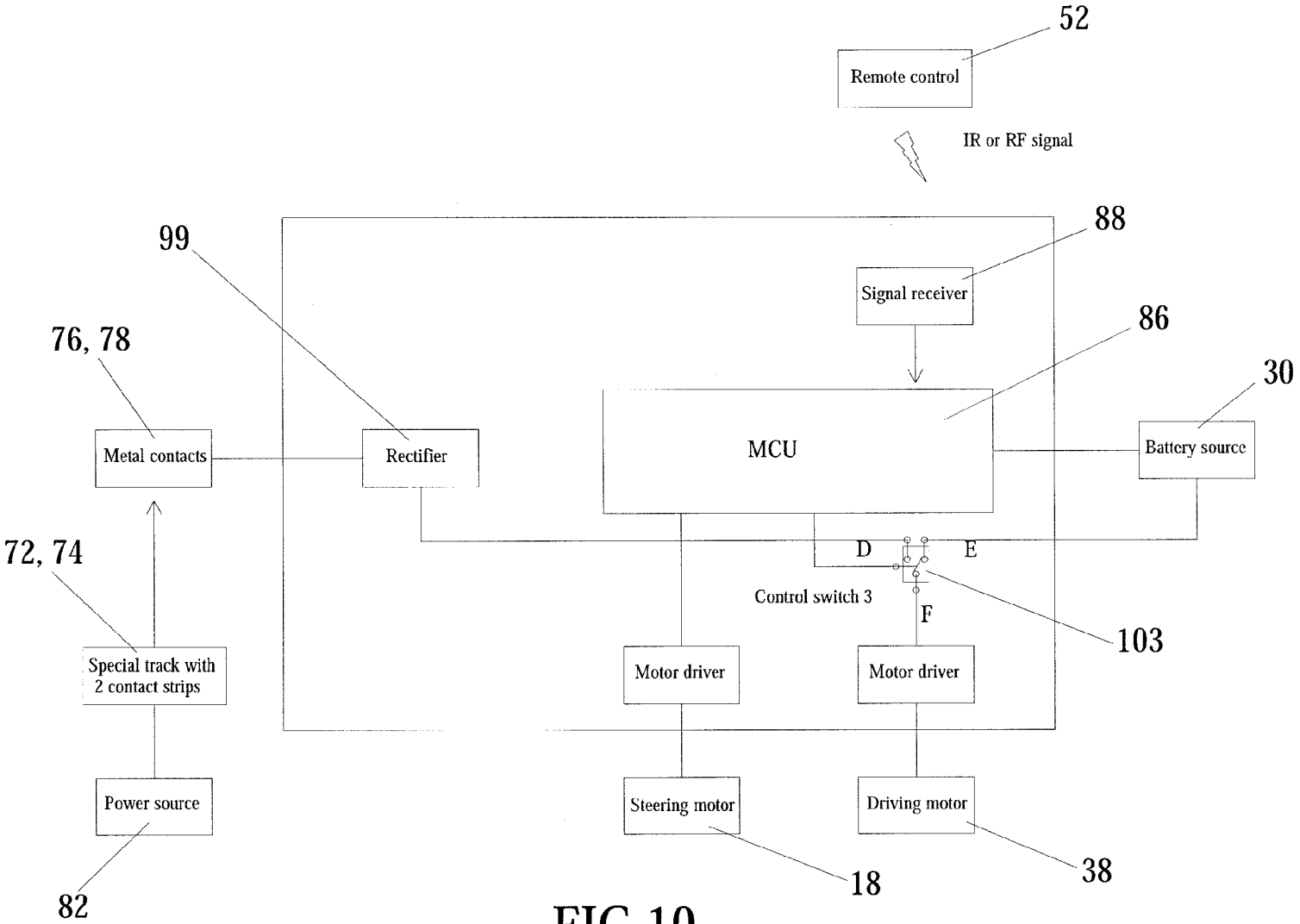
FIG. 10 shows the block diagram of whole vehicle system without a capacitor and also the remote control interaction.

The operation of FIG. 10, the mode without a capacitor is described. There is only a single control switch 3, namely switch 103 Here the MCU compares the voltage level from the battery source 30 and the rectifier 99. The higher voltage level is the one applied to provide power to driving motor 38.

Figure 11:
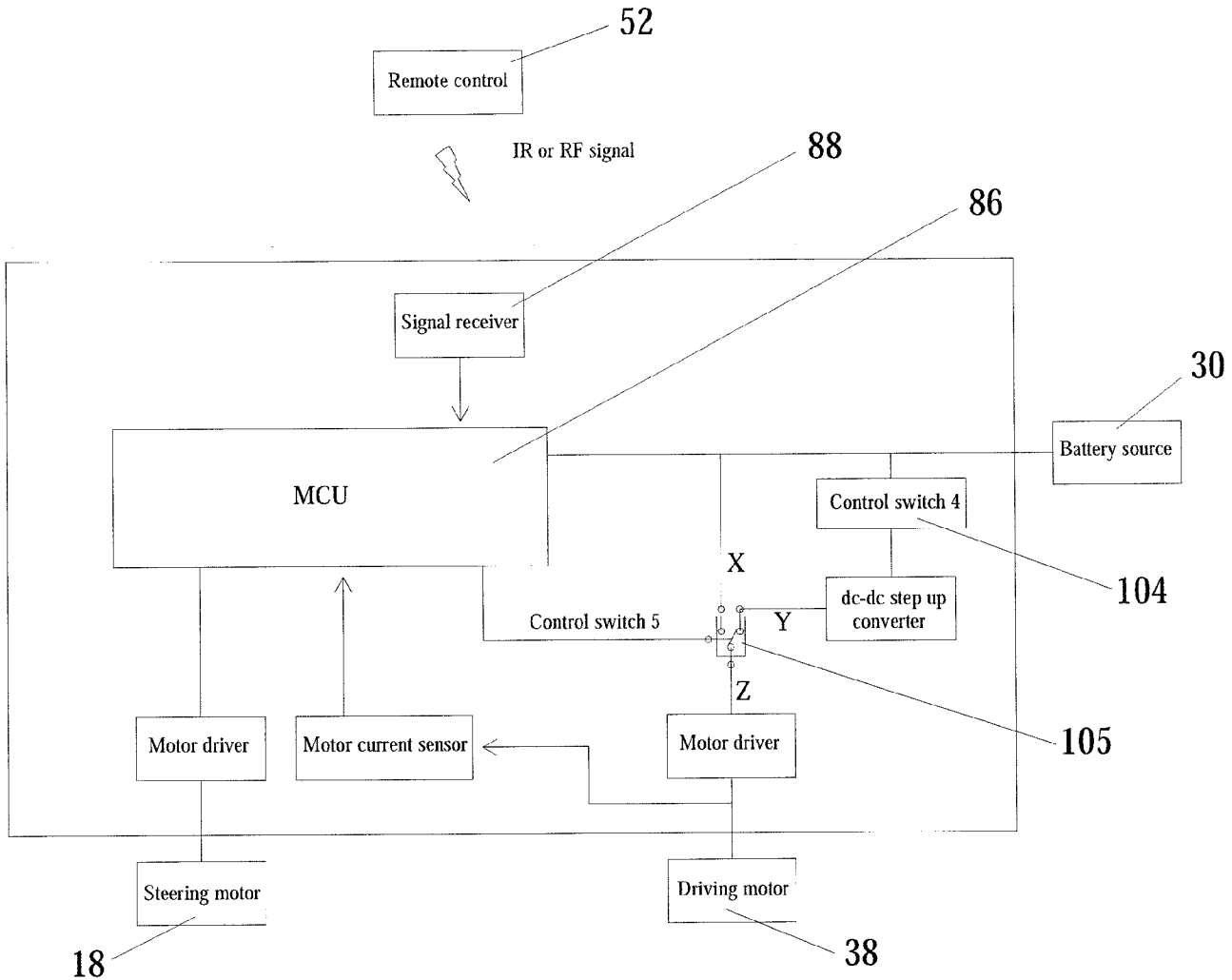
FIG. 11 shows the block diagram of whole vehicle system with a dc-dc step up converter and also the remote control interaction.

The operation of FIG. 11, the mode with a dc-dc step up converter is described. In normal play, the MCU switches a control switch 5, namely switch 105 to position X. The battery source 30 provides the motor current. Additionally, MCU monitors the motor current by a motor current sensor. Once the motor current is below a threshold value, the vehicle enters a "Ready for Turbo" mode. If the corresponding Turbo command is received from signal receiver 88, the MCU turns on switch 4, namely switch 104, to activate the dc-dc step-up converter and switch the control switch 5, 105 to the position Y. In this case, the converter supplies higher voltage to motor driver and the driving motor 38 accelerates instantly.

It will be understood that the remote controller can be formed of a variety materials and may be modified to include additional switches and/or buttons. It will be further understood that a variety of other types of controllers may be used to control the operation of the toy vehicle of the present disclosure.

One of ordinary skill will appreciate that although the embodiments discussed above refer to a single orientation sensor, there could be more than one sensor with the toy vehicle 10 and other modes of operation could be used.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure.

Many of the features of the present disclosure are implemented by suitable algorithms that are executed by one or more the microcontrollers with the vehicle and/or remote controller. For example, all voltages and, currents at critical circuit points, and velocity are monitored by the software routines.

Although the present disclosure has been described with respect to particular embodiments thereof, variations are possible. Although the disclosure is described of a four-wheeled embodiment, the present disclosure there could also comprise a vehicle having three wheels, or more than four wheels or a track drive system. There may be a motorcycle format with two wheels, or a system with 3 wheels, for instance two in the rear and one in the front.

The present disclosure may be embodied in specific forms without departing from the essential spirit or attributes thereof. In particular, although the disclosure is illustrated using a particularly format with particular component values, one skilled in the art will recognize that various values and schematics will fall within the scope of the disclosure. It is desired that the embodiments described herein be considered in all respects illustrative and not restrictive and that reference be made to the appended claims and their equivalents for determining the scope of the disclosure.

The invention claimed is:

1. A method of operating a toy, the vehicle including a body, a chassis, at least one drive wheel for engaging a surface for moving the vehicle on the surface, a power source with at least one battery comprising the steps of:

(a) moving a toy vehicle by control from a remote control device having controls;

(b) regulating the movement of the toy by a user to operating the remote control device;

(c) operating the power source to activate and power at least one drive electric motor;

(d) driving and turning the drive wheel of the vehicle at different normal speeds, the normal speeds including a normal top speed;

(e) controlling the speed of the motor through an electronic circuit;

(f) receiving by a receiver with the vehicle a signal from a transmitter with the remote control device;

(g) supplying a source of supplemental power for selectively energizing the drive motor with additional power;

(h) providing the drive motor with extra power in addition to the power from the battery; and (i) boosting the drive motor to turn the drive wheel faster than the normal top speed whereby the vehicle moves faster than the normal top speed under battery power; wherein the source of supplemental power includes a capacitor in the vehicle, including the steps of providing the additional power to energize the motor from the capacitor, and including detecting a voltage to monitor the capacitor voltage level, and wherein when the voltage level of the capacitor is higher than a threshold value, permitting the vehicle to enter a mode to permit the supplemental power to be activated to boost the drive motor.

2. A method of operating a toy, the vehicle including a body, a chassis, at least one drive wheel for engaging a surface for moving the vehicle on the surface, a power source with at least one battery comprising the steps of:

(a) moving a toy vehicle by control from a remote control device having controls;

(b) regulating the movement of the toy by a user to operating the remote control device;

(c) operating the power source to activate and power at least one drive electric motor;

(d) driving and turning the drive wheel of the vehicle at different normal speeds, the normal speeds including a normal top speed;

(e) controlling the speed of the motor through an electronic circuit;

(f) receiving by a receiver with the vehicle a signal from a transmitter with the remote control device;

(g) supplying a source of supplemental power for selectively energizing the drive motor with additional power;

(h) providing the drive motor with extra power in addition to the power from the battery; and (i) boosting the drive motor to turn the drive wheel faster than the normal top speed whereby the vehicle moves faster than the normal top speed under battery power; wherein the source of supplemental power includes a dc-dc converter in the vehicle, including the steps of providing the additional power to energize the motor from the converter, and including detecting a current to monitor the drive motor current level, and wherein when the current level is lower than a threshold value, permitting the vehicle to enter a mode to permit the supplemental power to be activated to boost the drive motor.

3. A method of operating a toy, the vehicle including a body, a chassis, at least one drive wheel for engaging a surface for moving the vehicle on the surface, a power source with at least one battery comprising the steps of:

(a) moving a toy vehicle by control from a remote control device having controls;

(b) regulating the movement of the toy by a user to operating the remote control device;

(c) operating the power source to activate and power at least one drive electric motor;

(d) driving and turning the drive wheel of the vehicle at different normal speeds, the normal speeds including a normal top speed;

(e) controlling the speed of the motor through an electronic circuit;

(f) receiving by a receiver with the vehicle a signal from a transmitter with the remote control device;

(g) supplying a source of supplemental power for selectively energizing the drive motor with additional power;

(h) providing the drive motor with extra power in addition to the top power level from the battery; and (i) boosting the drive motor to turn the drive wheel faster than the normal top speed whereby the vehicle moves faster than the normal top speed under battery power.

4. The method of claim 3 including a track for the vehicle, the track including a contact for engagement with a mating contact on the vehicle, and (a) connecting the source of supplemental power to the vehicle and to the driving motor when the vehicle passes a select portion of the track, and (b) transmitting the supplemental power to the driving motor.

5. The method of claim 3 including a power storage capacitor with the vehicle as the source of supplemental power for connection for the drive motor, and (a) providing to the motor when the vehicle receives a signal from the remote controller device;

(b) processing through the electronic circuit the signal onboard the vehicle;

(c) generating an output through the electronic circuit; and (d) transmitting the supplemental power, whereby the supplemental power is transmittable to the driving motor.

6. The method of claim 3 including a pair of metal brushes or contact plates with the vehicle, and connecting the brushes or plates to the electronic circuit.

7. The method of claim 3 including a track running the vehicle, and the track including a section including two metal strips and (a) conducting electricity from the track to the vehicle;

(b) having the source of supplemental power as an external dc power source connected to the metal strips; and (c) setting a supply voltage of the power source is about at least 1.1 times higher than the battery level inside the vehicle.

8. The method of claim 7 including providing an external dc power source for energy to the electric motor inside the car when the vehicle passes through this track section.

9. The method of claim 7 including increasing suddenly the supplemental power source and boosting the operating voltage of the drive motor for the vehicle; and causing the motor to gain speed instantly along the track.

10. The method of claim 7 including a high energy capacitor in the vehicle for charge storage, charging the capacitor when the vehicle passes through the track section, and wherein by remote control of the electronic circuit of the vehicle, signally the receiver thereby causing a quick discharging the capacitor to the drive motor at anytime and running the vehicle faster at that time.

11. The method of claim 3 including measuring the voltage to the vehicle motor, and after stepping up the voltage to the drive motor, detecting a drive motor current increase in excess of the capability of vehicle, and disabling the source of supplemental power whereby the motor supply voltage returns to a normal low voltage state.

12. The method of claim 3 including measuring the voltage to the vehicle motor, and after stepping up the voltage to the drive motor, detecting a drive motor current being essentially normal relative to the capability of vehicle, enabling the source of supplemental power in the vehicle and increasing the motor supply voltage above a normal voltage state, and operating the remote control to transmit a signal to the receiver on the vehicle, and permitting more power to be provided to motor.

13. The method of claim 11 wherein the source of supplemental power includes a step up converter obtaining power directly from a battery in the vehicle.

14. The method of claim 12 wherein the source of supplemental power includes a step up converter and obtaining power directly from a battery in the vehicle.

15. The method of claim 11 wherein the source of supplemental power includes a step up converter connected, and obtaining power from a separate power source remote from the vehicle.

16. The method of claim 12 wherein the source of supplemental power includes a step up converter and obtaining power from a separate power source remote from the vehicle.

17. The method of claim 3 wherein the source of supplemental power includes a step up converter connected to obtain power from a separate power source remote from the vehicle.

18. The method of claim 3 including a track for the vehicle, and wherein source of supplemental power is connected to the vehicle and provided to the motor when the vehicle passes a select portion of the track, the track including a contact for engagement with a mating contact on the vehicle and transmitting the supplemental power to the drive motor.

19. The method of claim 18 including providing energy to the electric motor inside the car when the vehicle passes through this track section, and effecting a connection to the external dc power source.

20. The method of claim 18 including increasing suddenly the supplemental power source and boosting the operating voltage of the drive motor for the vehicle; and causing the motor to gain speed instantly along the track.

21. The method of claim 18 including a high energy capacitor in the vehicle for charge storage, charging the capacitor when the vehicle passes through the track section, and wherein by remote control of the electronic circuit of the vehicle, signally the receiver thereby causing a quick discharging the capacitor to the drive motor at anytime and running the vehicle faster at that time.

22. A method of operating a toy, the vehicle including a body, a chassis, at least one drive wheel for engaging a surface for moving the vehicle on the surface, a power source with at least one battery comprising the steps of:

(a) moving a toy vehicle by control from a remote control device having controls;

(b) regulating the movement of the toy by a user to operating the remote control device;

(c) operating the power source to activate and power at least one drive electric motor;

(d) driving and turning the drive wheel of the vehicle at different normal speeds, the normal speeds including a normal top speed;

(e) controlling the speed of the motor through an electronic circuit;

(f) receiving by a receiver with the vehicle a signal from a transmitter with the remote control device;

(g) supplying a source of supplemental power for selectively energizing the drive motor with additional power;

(h) providing the drive motor with extra power in addition to the power from the battery;

(i) boosting the drive motor to turn the drive wheel faster than the normal top speed whereby the vehicle moves faster than the normal top speed under battery power, including a track for the vehicle, and (j) connecting the source of supplemental power to the vehicle;

(k) provided to the motor when the vehicle passes a select portion of the track the supplemental power to the drive motor;

(l) measuring the voltage to the vehicle motor;

(m) stepping up the voltage to the drive motor;

(n) detecting a drive motor current increase in excess of the capability of vehicle, the source of supplemental power being disabled whereby the motor supply voltage returns to a normal low voltage state;

(o) after stepping up the voltage to the drive motor, and detecting a drive motor current being essentially normal relative to the capability of vehicle, enabling the source of supplemental power in the vehicle whereby the motor supply voltage is increased above a normal low voltage state, and (p) operating the remote control to transmit a signal to the receiver on the vehicle providing more power to the motor.

23. The method of claim 3 wherein the normal top speed under battery power is the top speed when the battery is fully charged.

24. The method of claim 18 wherein the normal top speed under battery power is the top speed when the battery is fully charged.

25. The method of claim 22 wherein the normal top speed under battery power is the top speed when the battery is fully charged.

26. The method of claim 3 wherein the source of supplemental power is a power source wherein a supply voltage of the power source is about at least 1.1 times higher than the battery voltage.

27. The method of claim 18 wherein the source of supplemental power is a power source wherein a supply voltage of the power source is about at least 1.1 times higher than the battery voltage.

28. The method of claim 22 wherein the source of supplemental power is a power source wherein a supply voltage of the power source is about at least 1.1 times higher than the battery voltage.

* * * * *